US009577337B2

(12) United States Patent
Jung et al.

(10) Patent No.: US 9,577,337 B2
(45) Date of Patent: Feb. 21, 2017

(54) DUAL-POLARIZED ANTENNA FOR MOBILE COMMUNICATION BASE STATION

(71) Applicant: Electronics & Telecommunications Research Institute, Daejeon (KR)

(72) Inventors: Jae Ho Jung, Daejeon (KR); Jung Nam Lee, Daejeon (KR); Kwang Chun Lee, Daejeon (KR)

( * ) Notice: Subject to any disclaimer, the term of this patent is extended or adjusted under 35 U.S.C. 154(b) by 157 days.

(21) Appl. No.: 14/538,168

(22) Filed: Nov. 11, 2014

(65) Prior Publication Data

US 2015/0130682 A1 May 14, 2015

(30) Foreign Application Priority Data

Nov. 11, 2013 (KR) ..... 10-2013-0136507

(51) Int. Cl.
*H01Q 9/04* (2006.01)
*H01Q 1/52* (2006.01)
*H01Q 1/24* (2006.01)

(52) U.S. Cl.
CPC ..... *H01Q 9/0457* (2013.01); *H01Q 1/525* (2013.01); *H01Q 1/246* (2013.01)

(58) Field of Classification Search
CPC ..... H01Q 9/0457
See application file for complete search history.

(56) References Cited

U.S. PATENT DOCUMENTS 6,028,563 A 2/2000 Higgins
2005/0116867 A1* 6/2005 Park ..... H01Q 9/0414 343/725
2009/0096700 A1 4/2009 Chair
2012/0007786 A1* 1/2012 Ando ..... H01Q 9/0407 343/749
2012/0032865 A1* 2/2012 Toyao ..... H01P 1/2005 343/835

FOREIGN PATENT DOCUMENTS

JP 10-2010-0134552 12/2010
KR 10-2005-0025903 3/2005
KR 1020080033660 4/2008
KR 10-2012-0088471 8/2012
WO WO 01/41256 A1 * 6/2001
WO 2009/080644 A2 7/2009

OTHER PUBLICATIONS

Lee, Jung N. et al., "Design of dual-polarised compact base station antenna with high isolation using spiral resonator," Electronic Letters, vol. 49(20):1257-1258 (2013).

* cited by examiner

*Primary Examiner* — Robert Karacsony
(74) *Attorney, Agent, or Firm* — Nelson Mullins Riley & Scarborough LLP

(57) ABSTRACT

Disclosed is a dual polarization-based small antenna for a mobile communication base station. The dual-polarized antenna includes a substrate, a first feed attached to one surface of the substrate, a second feed spaced apart from the first feed and attached to the one surface of the substrate, a radiator located above the first feed and the second feed, and a spiral resonator located between the first feed and the second feed. The dual-polarized antenna effectively provides a broad bandwidth and a high isolation characteristic while having a reduced size, and the spiral resonator allows the isolation characteristic at a certain narrow band range to be effectively enhanced by adjusting of the position, size, and shape of the spiral resonator without affecting the operating frequency of the dual-polarized antenna.

9 Claims, 8 Drawing Sheets

DUAL-POLARIZED ANTENNA FOR MOBILE COMMUNICATION BASE STATION

CLAIM FOR PRIORITY

This application claims priority to and the benefit of Korean Patent Application No. 10-2013-0136507 filed on Nov. 11, 2013 in the Korean Intellectual Property Office (KIPO), the entire contents of which are hereby incorporated by reference.

BACKGROUND

1. Technical Field

Example embodiments of the present invention relate in general to the field of an antenna for a mobile communication base station, and more specifically to a dual polarization-based small antenna for a mobile communication base station.

2. Related Art

The mobile communication technology of today has been converted from an analog communication into a digital communication, and further evolved into 2G, 3G, and 4G. In particular, 3.9G services represented by LTE and WiMax are being introduced all over the world. As smart devices of a high performance, such as smartphones and tablets, are spread into public together with the development of the communication technology, the demand for a big data service such as high-definition multimedia is explosively increased, and thus a tremendous mobile traffic is expected in the near future.

For a paradigm of a mobile communication technology, advanced technologies, including an active phased array antenna technology, a multiple-input and multiple-output (MIMO) technology, and a beamforming technology, have been introduced and evolved as a method of increasing the data transmission speed and data transmission capacity to the utmost by using limited frequency resources.

However, the speed of development in the advanced technology does not catch up with the proliferation of the mobile traffic that increases by geometric progression. As a solution to the mobile traffic increasing due to the limited frequency resources and the commercialization of mobile communication technology, there is suggestion about gradually increasing the number of base stations. However, the suggested method of increasing the number of mobile communication base stations has drawbacks of increasing the energy consumption, the space required for base stations, and the maintenance cost for base stations in the position of a mobile operator, and therefore the method is found difficult to be converted into a new service that will be developed in the future.

A next generation mobile communication base station system needs to satisfy the demand for mobile traffics that increases by geometric progression based on the current system, and also needs to quickly respond to a new communication market that is to be developed in the future. The current mobile communication base station has a system configuration thereof changed such that an RF unit is separated from a base band unit and an antenna is provided adjacent to the RF unit to minimize the cable loss between the antenna and the system, thereby minimizing the power consumption and expanding the coverage and thus compensating for the constraints with the increasing mobile traffic.

Meanwhile, the mobile communication base station system has an architecture in which a Radio Frequency Unit (RFU), a Base Band Unit (BBU), and a Transport layer are located in one cabinet and connected to a transmission/reception antenna through a coaxial line. However, in the recent years, the mobile communication base station system has been developed in the form of a distributed base station in which a centralized station collected with a plurality of Digital Units (DUs) is separated from a Radio Unit (RU) referred to as a Remote Radio Unit (RRH), and the centralized station is connected to the RRH by using an optical line. That is, the next generation mobile communication base station is provided such that an RF unit separately provided from a baseband unit is connected to the baseband unit through an optical line, and then made adjacent to an antenna, in which the RF unit is provided in a compact structure and integrated into an antenna construction.

In order to achieve miniaturization of the compact RF unit in the next generation mobile communication base station system, the antenna needs to be reduced in size. That is, the reducing of the next generation mobile communication base station in size is determined by the miniaturization of the antenna, that is, a device taking the largest volume among single RF devices in the next generation mobile communication base station. However, the antenna used in the current base station has a significantly large size, and provided as an array antenna having a plurality of antennas in a single construction, therefore such an antenna has a difficulty in application to the next generation mobile communication base station.

SUMMARY

Accordingly, example embodiments of the present invention are provided to substantially obviate one or more problems due to limitations and disadvantages of the related art.

Example embodiments of the present invention provide a dual-polarized small antenna for a base station.

Example embodiments of the present invention also provide a dual-polarized small antenna for a base station in which the isolation characteristic is enhanced.

In some example embodiments, a dual-polarized antenna includes: a substrate, a first feed, a second feed, a radiator, and a spiral resonator. The first feed may be attached to one surface of the substrate. The second feed may be spaced apart from the first feed and attached to the one surface of the substrate. The radiator may be located above the first feed and the second feed. The spiral resonator may be located between the first feed and the second feed.

Each of the first feed and the second feed may have a bent '¬' shape formed by bending a metal plate.

Each of the first feed and the second feed may be provided as the bent '¬' shape while having a same height.

The radiator may include a metal plate provided in one of a circular shape, an oval shape, and a polygonal shape, and located in parallel to the substrate.

The spiral resonator may be provided by etching a line having an eddy shape in a dielectric substrate.

The spiral resonator may be located at the same height as heights of the first feed and the second feed each having the bent '¬' shape.

The dual-polarized antenna may further include a shorting pin connected to the eddy-shaped line to earth the eddy-shaped line.

The shorting pin may include a first shorting pin connected to a start portion that is provided at a center of the eddy-shaped line, and a second shorting pin connected to an end portion of the eddy-shaped line.

The substrate, the first feed, the second feed, the radiator, and the spiral resonator may be mounted in a metal cube having a cavity at a center portion thereof.

As is apparent from the above, the dual-polarized antenna provided with the spiral resonator can effectively provide a broad bandwidth and a high isolation characteristic while having a reduced size.

In addition, the spiral resonator can allow the isolation characteristic at a certain narrow band range to be effectively enhanced by adjusting of the position, size, and shape of the spiral resonator without affecting the operating frequency of the dual-polarized antenna.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS

Figure 1:
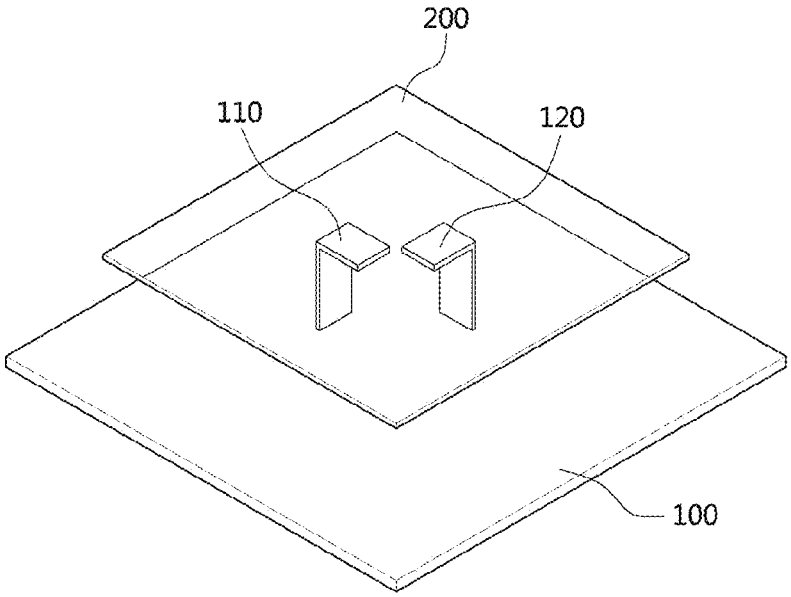
FIG. 1 is a perspective view illustrating a basic structure of a dual-polarized antenna.

Example embodiments of the present invention are disclosed herein. However, specific structural and functional details disclosed herein are merely representative for purposes of describing example embodiments of the present invention, and example embodiments of the present invention may be embodied in many alternative forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes," and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a perspective view illustrating a basic structure of a dual-polarized antenna.

Referring to FIG. 1, a dual-polarized antenna includes a substrate 100, feeds 110 and 120, and a radiator 200. The two feeds 110 and 120 may be attached to an upper surface of the substrate 100, and the radiator 200 may be located above the feeds 110 and 120 while being spaced apart from the feeds 110 and 120.

The substrate 100 may be formed of a dielectric material, and a first feed 110 and a second feed 120 may be attached to one surface of the substrate 100. The first feed 110 is a feed line for transmission, and the second feed 120 is a feed line for reception.

The first feed 110 and the second feed 120 are located at the center of the substrate 100 while being spaced apart from each other. The first feed 110 and the second feed 120 are attached while being spaced apart from each other, allowing an isolation characteristic to be provided between the two feed lines.

However, as the dual-polarized antenna for a base station is provided in miniaturization, a distance in which the first feed 110 is spaced apart from the second feed 120 is limited. Accordingly, such a miniaturization of the dual-polarized antenna for a base station may lead to degradation of the isolation characteristic between the first feed 110 and the second feed 120. That is, there is a limitation in maintaining the isolation characteristic between the first feed 110 and the second feed 120 while having the dual-polarized antenna in a small size.

The radiator 200 may be a metal plate located in parallel to the substrate 100 while being spaced apart from the first feed 110 and the second feed 120. The radiator 200 may transmit and receive electromagnetic waves to/from the first feed 110 and the second feed 120.

In addition, the radiator 200 may be a metal plate having a circular shape, an oval shape, or a polygonal shape, but the shape of the radiator 200 is not limited thereto.

Figure 2:
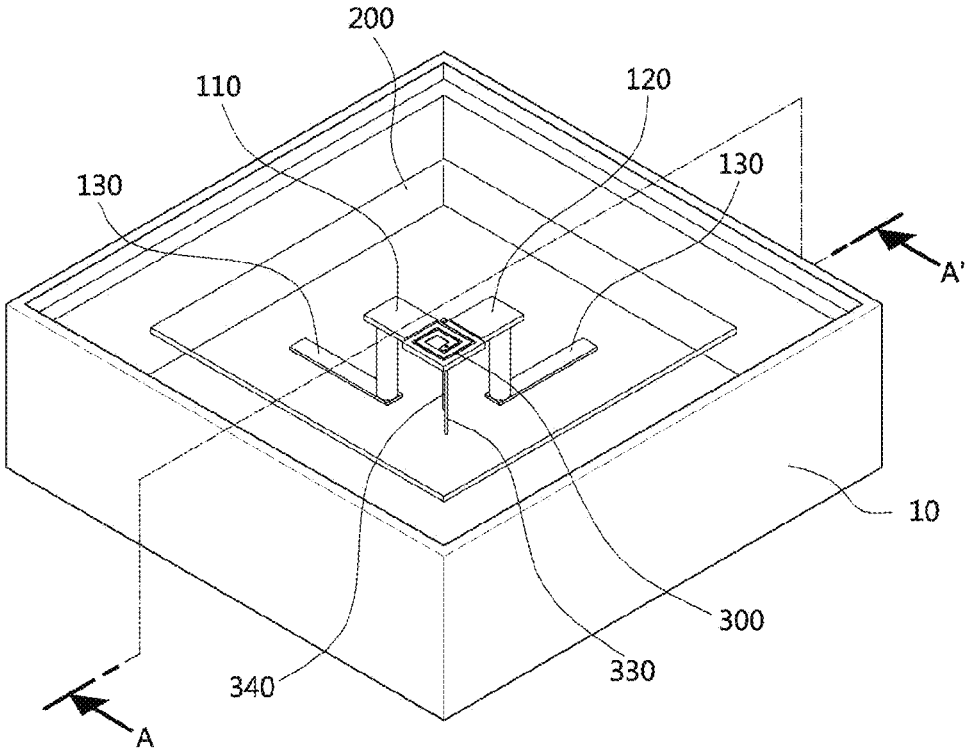
FIG. 2 is a perspective view illustrating a structure of a dual-polarized antenna according to an example embodiment of the present invention.
Figure 3:
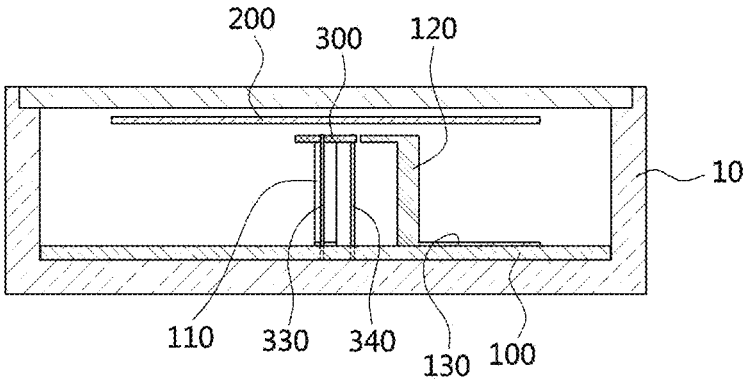
FIG. 3 is a cross-sectional view illustrating a structure of a dual-polarized antenna according to an example embodiment of the present invention.
Figure 4:
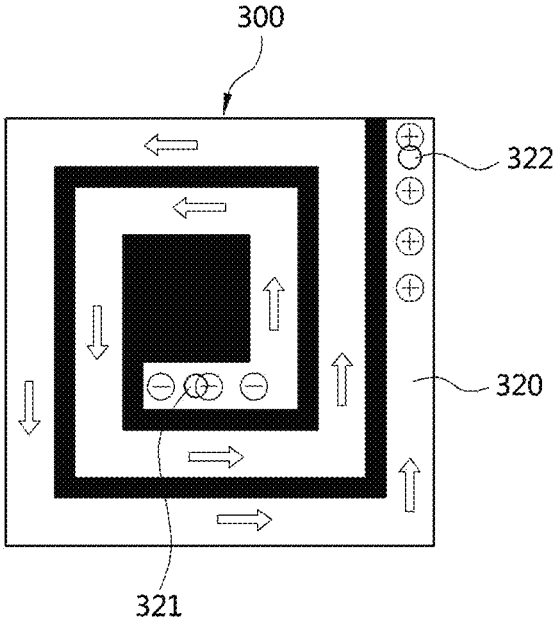
FIG. 4 is a plan view illustrating a spiral resonator of a dual-polarized antenna according to an example embodiment of the present invention.

FIG. 2 is a perspective view illustrating a structure of a dual-polarized antenna according to an example embodiment of the present invention, FIG. 3 is a cross-sectional view illustrating a structure of a dual-polarized antenna according to an example embodiment of the present invention, and FIG. 4 is a plan view illustrating a spiral resonator of a dual-polarized antenna according to an example embodiment of the present invention.

Referring to FIGS. 2 and 3, the dual-polarized antenna according to an example embodiment of the present invention includes the substrate 100, the feeds 110 and 120, a spiral resonator 300, and the radiator 200. FIG. 3 is a cross-sectional view taken along line A-A' of FIG. 2.

The substrate 100, the feeds 110 and 120, the radiator 200, and the spiral resonator 300 may be mounted in a metal cube 10 having a cavity at a center thereof. The cavity may have a rectangular parallelepiped shape. For example, the metal cube 10 may have a size corresponding to ¼ or ½ of the operating frequency wavelength (λ).

However, according to the present invention, the substrate 100, the feeds 110 and 120, the radiator 200, and the spiral resonator 300 may be mounted by using a shape different from that of the metal cube 10 having a cavity at the center thereof.

The first feed 110 and the second feed 120 may be attached to one surface of the substrate 100, and the first feed 110 and the second feed 120 may be spaced apart from each other. In addition, the first feed 110 and the second feed 120 may be attached to the substrate 100 in a direction perpendicular to the substrate 100.

In detail, each of the first feed 110 and the second feed 120 may have a bent '¬' shape formed by bending a metal plate. In this case, the metal plate bent in the '¬' shape may have a circular shape, an oval shape, or a polygonal shape.

In addition, each of the first feed 110 and the second feed 120 bent in the '¬' shape may have the same height, and the first feed 110 and the second feed 120 are disposed in perpendicular to each other to form a dual polarization. The first feed 110 and the second feed 120 may be connected to a feeding line through a micro strip 130 printed on the substrate 100. For example, the first feed 110 and the second feed 120 may excite a signal by being connected to a SubMiniature version A (SMA) connector through the microstrip 130.

The radiator 200 may be located above the first feed 110 and the second feed 120. The radiator 200 may be provided as a metal plate having one of a circular shape, an oval shape, and a polygonal shape, and may be installed at a position parallel to the substrate 100. The radiator 200 may be fixed by being connected to the metal cube 10 through an insulating material.

Referring to FIG. 4, the spiral resonator 300 may be located between the first feed 110 and the second feed 120. That is, the spiral resonator 300 may be located between the first feed 110 and the second feed 120 to prevent leakage currents excited in the first feed 110 and the second feed 120, respectively, from affecting each other.

For example, the spiral resonator 300 may be used for implementation of meta-materials, and provided in the form of a split ring resonator (SRR). The SRR is a structure used for Left-Handed Materials (LHM), and provides a μ-negative (MNG) value. However, the SRR may provide an ∈-negative (ENG) value in a wire medium.

According to the example embodiment of the present invention, the spiral resonator 300 may be provided using a Spiral Resonator (SR) that is one type of a magnetic field resonator. The SR is characterized in providing a band stop characteristic when there is a need to block a desired frequency band, and such a characteristic of the SR is applied to the dual-polarized antenna, to improve the isolation characteristic between two antennas.

The spiral resonator 300 may have a structure formed by etching a line 320 having an eddy shape in a dielectric substrate 310. The eddy-shaped line 320 may be etched in the form of a circle or square on the dielectric substrate 310.

When a time-varying magnetic field is applied to the eddy-shaped line 320 from the outside, an electric current may be induced in the eddy-shaped line 320, and a distributed inductance may be generated corresponding to a length of the line flown by the induced current, and a mutual inductance between the lines may be generated. In addition, a distributed capacitance may be generated between an inner line and an outer line, and a fringing capacitance may be generated at both ends of the line.

Accordingly, the spiral resonator 300 may operate in the same manner as an LC resonance circuit in a general band stop filter, as shown in FIG. 1 below.

$$\omega_0 = \sqrt{\frac{1}{L_T C_T}} \quad \text{[Equation 1]}$$

In Equation 1, $\omega_0$ is a resonant frequency, $L_T$ is an inductance, and $C_T$ is a capacitance.

In addition, the spiral resonator 300 may be located at the same height as those of the first feed 110 and the second feed 120 each having a bent '¬' shape.

The dual-polarized antenna according to the example embodiment of the present invention may further include shorting pins 330 and 340. The shorting pins 330 and 340 are connected to the eddy-shaped line 320 forming a part of the spiral resonator 300, to earth the eddy-shaped line 320.

In detail, the shorting pins 330 and 340 include a first shorting pin 330 connected to a start portion 321 provided at the center of the eddy-shaped line 320 and a second shorting pin 340 connected to an end portion 322 of the eddy-shaped line 320. The first shorting pin 330 and the second shorting pin 340 may be installed in perpendicular to the substrate 100, and connected to the metal cube 10 by passing through the substrate 100. That is, as the eddy-shaped line 320 of the spiral resonator 300 is put to earth by the first shorting pin 330 and the second shorting pin 340, the isolation between the first feed 110 and the second feed 120 is enhanced.

Figure 5:
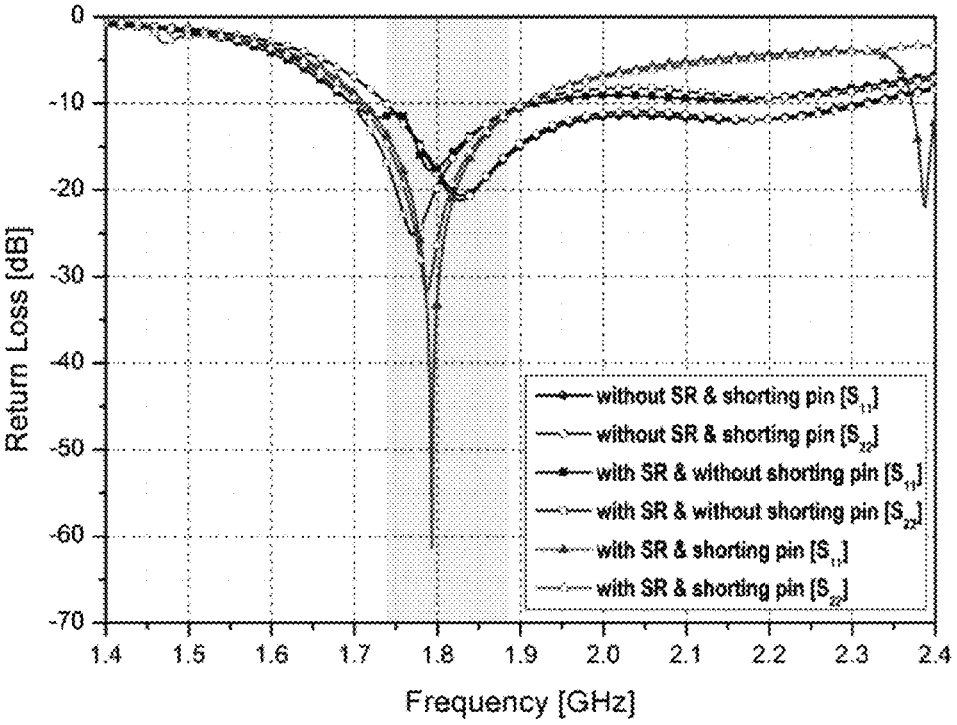
FIG. 5 is a graph showing a return loss of a dual-polarized antenna according to an example embodiment of the present invention.
Figure 6:
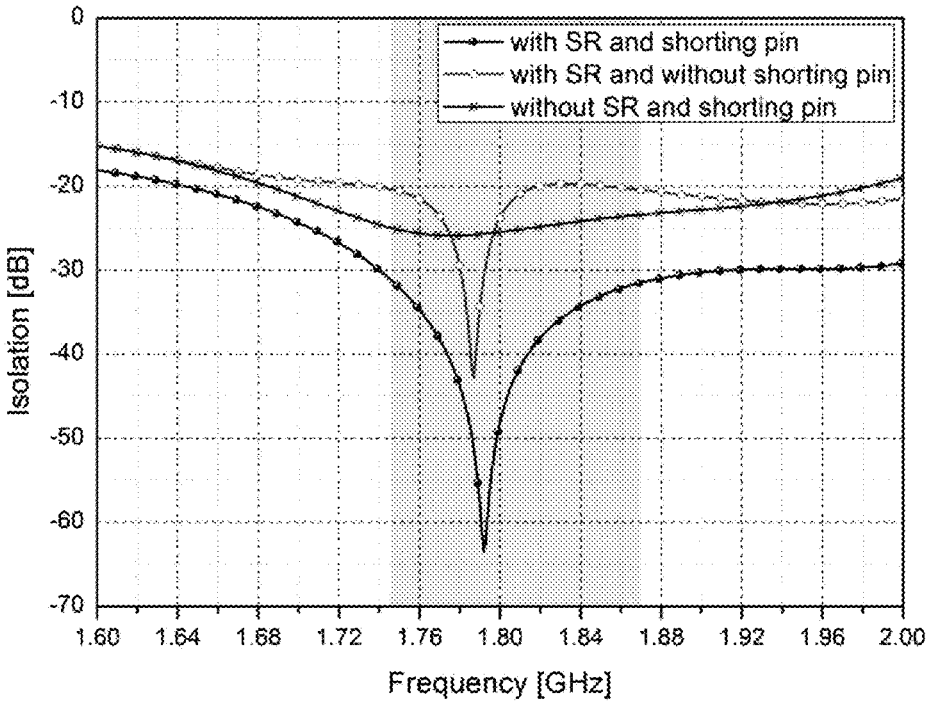
FIG. 6 is a graph showing an isolation of a dual-polarized antenna according to an example embodiment of the present invention.

FIG. 5 is a graph showing a return loss of a dual-polarized antenna according to an example embodiment of the present invention, and FIG. 6 is a graph showing an isolation of a dual-polarized antenna according to an example embodiment of the present invention.

FIGS. 5 and 6 show a simulation result of the return loss and the isolation characteristic of a dual-polarized antenna according to the example embodiment of the present invention.

Referring to FIG. 5, the return loss of the dual-polarized antenna is shown to vary depending on whether the dual-polarized antenna is provided with the spiral resonator 300 and the shorting pins 330 and 340. In FIG. 5, SR represents the spiral resonator 300, $S_{11}$ represents the first shorting pin 330, and $S_{22}$ represents the second shorting pin 340.

A dual-polarized antenna provided with the spiral resonator 300 has a return loss smaller than that of a dual-polarized antenna not provided with the spiral resonator 300. In addition, a dual-polarized antenna provided with the shorting pins 330 and 340 has a return loss smaller than that of a dual-polarized antenna not provided with the shorting pins 330 and 340.

In particular, at a frequency band of 1.8 GHz, a dual-polarized antenna provided with the spiral resonator 300 and the shorting pins 330 and 340 has a return loss significantly smaller than that of a dual-polarized antenna not provided with the spiral resonator 300 and the shorting pins 330 and 340. That is, the dual-polarized antenna provided with the spiral resonator 300 and the shorting pins 330 and 340 according to an example embodiment of the present invention shows a small return loss at a certain narrow band.

Referring to FIG. 6, the isolation characteristic of the dual-polarized antenna varies depending on whether the dual-polarized antenna is provided with each of the spiral resonator 300 and the shorting pins 330 and 340.

It is shown that a dual-polarized antenna provided with the spiral resonator 300 has an isolation higher than that of a dual-polarized antenna not provided with the spiral resonator 300. In addition, the isolation of the dual-polarized antenna is getting higher as the dual-polarized antenna is additionally provided with the shorting pins 330 and 340.

For example, in a frequency band between 1.76 GHz and 1.80 GHz, a dual-polarized antenna provided with the spiral resonator 300 and the shorting pins 330 and 340 has an isolation characteristic of about 60 dB at the maximum, but a dual-polarized antenna not provided with the spiral resonator 300 and the shorting pins 330 and 340 has an isolation characteristic of about 25 dB at the maximum. In addition, a dual-polarized antenna only provided with the spiral resonator 300 has an isolation characteristic of about 43 dB at the maximum.

That is, the isolation of dual polarization at a certain narrow band is enhanced by adding the spiral resonator 300 and the shorting pins 330 and 340 to the existing dual-polarized antenna.

FIGS. 7A to 7D are graphs showing isolations of a dual-polarized antenna according to an example embodiment of the present invention.

Figure 7A:
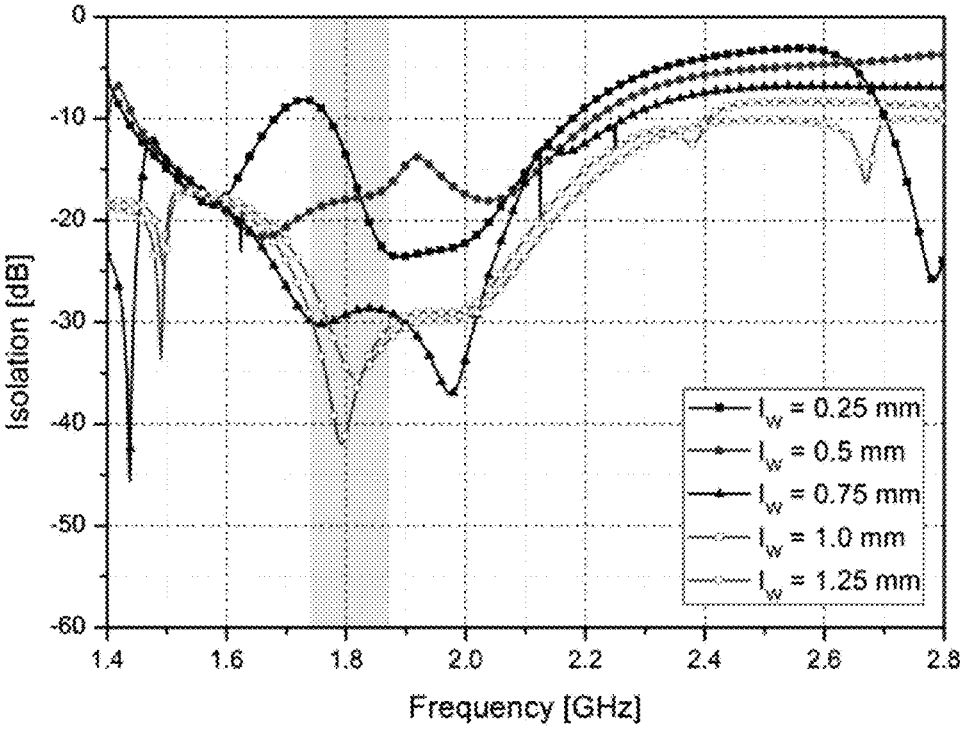
FIGS. 7A to 7D are graphs showing isolations of a dual-polarized antenna according to an example embodiment of the present invention.

FIG. 7A shows an isolation characteristic depending on a width $I_W$ of the eddy-shaped line 320 etched in the spiral resonator 300.

Referring to FIG. 7A, when the width of eddy-shaped line 320 is 0.75 mm or more, the isolation characteristic of the dual-polarized antenna is enhanced. In particular, as for a frequency band of 1.8 GHz, the dual-polarized antenna has the most superior isolation characteristic when the width of the eddy-shaped line 320 is 1.0 mm.

Figure 7B:
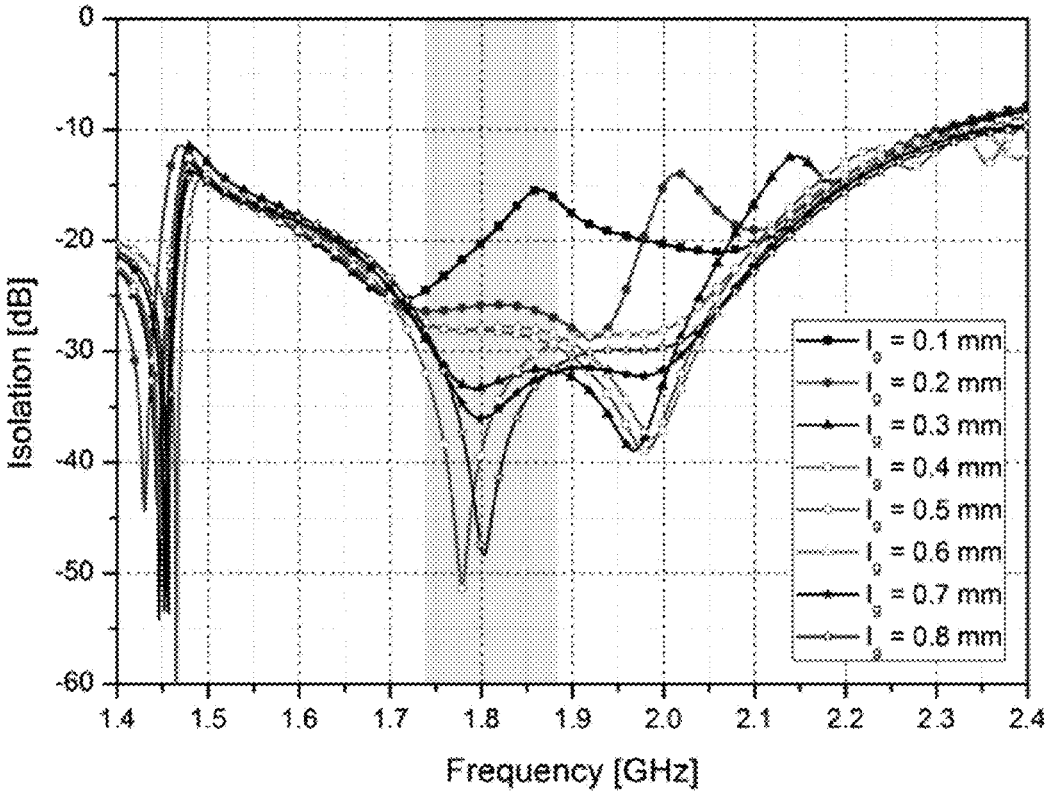

FIG. 7B shows the isolation characteristic depending on an interval $I_g$ between the eddy-shaped lines 320 etched in the spiral resonator 300.

Referring to FIG. 7B, when the interval between the eddy-shaped lines 320 is 0.5 mm or 0.8 mm, the isolation characteristic is distinctively enhanced. That is, in a frequency band of about 1.8 GHz, the dual-polarized antenna has an isolation characteristic of about 52 dB at the maximum when the interval of the eddy-shaped lines 320 is 0.5 mm, and the dual-polarized antenna has an isolation characteristic of about 47 dB at the maximum when the interval of the eddy-shaped lines 320 is 0.8 mm. Accordingly, the isolation characteristic is enhanced by adjusting the interval between the eddy-shaped lines 320.

Figure 7C:
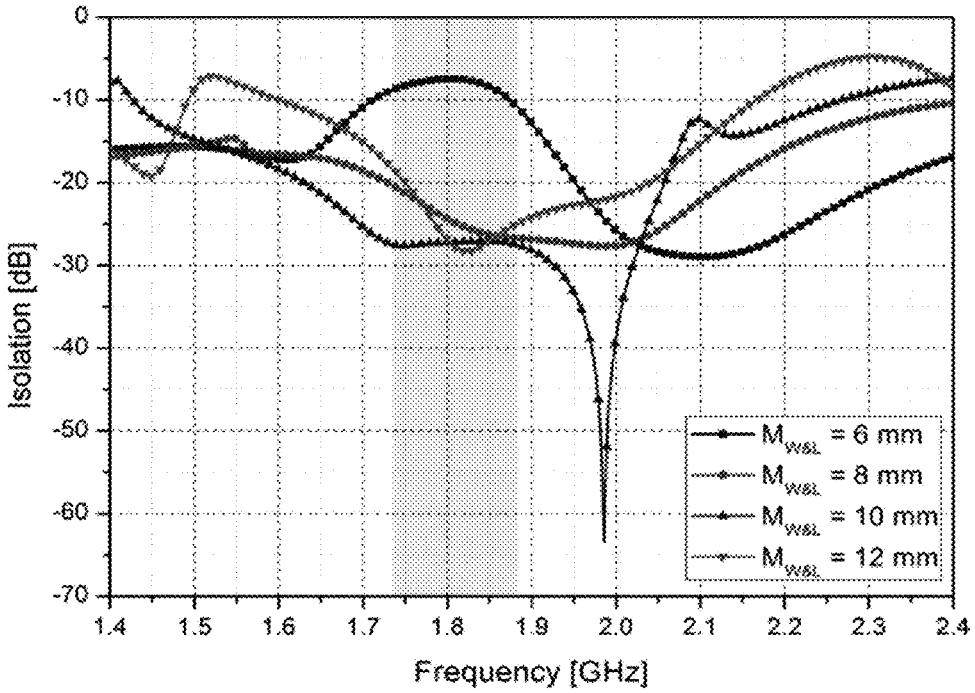

FIG. 7C shows isolation characteristics depending on a size $M_{W\&L}$ of the spiral resonator 300.

Referring to FIG. 7C, the bandwidth having an isolation increase is different at each size of the spiral resonator 300. In particular, when the length of each side of the spiral resonator 300 obtained by etching the eddy-shaped line 320 in the dielectric substrate 310 is 10 mm, the dual-polarized antenna has a significantly enhanced isolation at a frequency band of about 2 GHz.

Figure 7D:
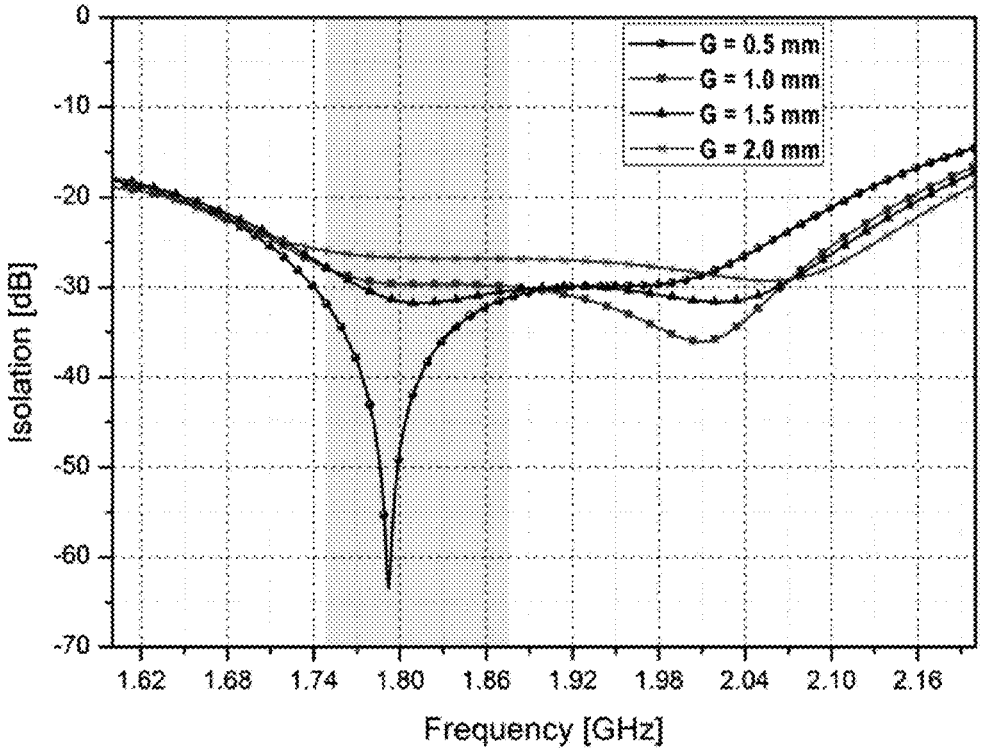

FIG. 7D shows isolation characteristics depending on a distance between the spiral resonator 300 and the feeds 110 and 120.

Referring to FIG. 7D, when the distance between the spiral resonator 300 and the first and second feeds 110 and 120 is 0.5 mm, the dual polarized antenna has a high isolation at a frequency of 1.8 GHz. That is, it is shown that the isolation characteristic is enhanced as the distance between the spiral resonator 300 and the feeds 110 and 120 is decreased.

Referring to FIGS. 7A to 7D, the isolation characteristic of the dual-polarized antenna according to the example embodiment of the present invention is determined by the position, size, and shape of the spiral resonator 300.

Accordingly, the isolation characteristic at a certain narrow band can be effectively enhanced by adjusting the position, size, and shape of the spiral resonator 300. In addition, the spiral resonator 300 may enable the isolation characteristic to be enhanced without affecting the operating frequency of the dual-polarized antenna.

The dual-polarized antenna provided with the spiral resonator 300 according to the example embodiment of the present invention can effectively provide a broad bandwidth and high isolation characteristic while having a reduced size.

While the example embodiments of the present invention and their advantages have been described in detail, it should be understood that various changes, substitutions, and alterations may be made herein without departing from the scope of the invention.

What is claimed is:

1. A dual-polarized antenna comprising:

a substrate;

a first feed attached to one surface of the substrate;

a second feed spaced apart from the first feed and attached to the one surface of the substrate;

a radiator located above the first feed and the second feed; and a spiral resonator located between the first feed and the second feed, the spiral resonator being provided by etching a line having an eddy shape in a dielectric substrate, wherein, an electric current is induced in the line having an eddy shape when a magnetic field is applied to the line, thus causing a mutual inductance between lines.

2. The dual-polarized antenna of claim 1, wherein each of the first feed and the second feed has a bent '¬' shape formed by bending a metal plate.

3. The dual-polarized antenna of claim 2, wherein each of the first feed and the second feed is provided as the bent '¬' shape while having a same height.

4. The dual-polarized antenna of claim 1, wherein the radiator includes a metal plate provided in one of a circular shape, an oval shape, and a polygonal shape, and located in parallel to the substrate.

5. A dual-polarized antenna comprising:

a substrate;

a first feed attached to one surface of the substrate;

a second feed spaced apart from the first feed and attached to the one surface of the substrate;

a radiator located above the first feed and the second feed; and a spiral resonator located between the first feed and the second feed, the spiral resonator being provided by etching a line having an eddy shape in a dielectric substrate, wherein each of the first feed and the second feed has a bent '¬' shape formed by bending a metal plate, and wherein the spiral resonator is located at the same height as heights of the first feed and the second feed each having the bent '¬' shape.

6. A dual-polarized antenna comprising:

a substrate;

a first feed attached to one surface of the substrate;

a second feed spaced apart from the first feed and attached to the one surface of the substrate;

a radiator located above the first feed and the second feed;

a spiral resonator located between the first feed and the second feed, the spiral resonator being provided by etching a line having an eddy shape in a dielectric substrate; and a shorting pin connected to the eddy-shaped line to earth the eddy-shaped line, wherein each of the first feed and the second feed has a bent '¬' shape formed by bending a metal plate.

7. The dual-polarized antenna of claim 6, wherein the eddy shape is a circular shape or a square shape.

8. The dual-polarized antenna of claim 6, wherein the shorting pin comprises:

a first shorting pin connected to a start portion that is provided at a center of the eddy-shaped line; and a second shorting pin connected to an end portion of the eddy-shaped line.

9. The dual-polarized antenna of claim 1, wherein the substrate, the first feed, the second feed, the radiator, and the spiral resonator are mounted in a metal cube having a cavity at a center portion thereof.

* * * * *